United States Patent [19]

Uuskallio

[11] Patent Number: 4,694,792

[45] Date of Patent: Sep. 22, 1987

[54] WET PRIMING MECHANISM FOR AN INTERNAL COMBUSTION ENGINE

[75] Inventor: Arvo F. Uuskallio, Hartland, Wis.

[73] Assignee: Briggs & Stratton Corporation, Wauwatosa, Wis.

[21] Appl. No.: 729,913

[22] Filed: May 3, 1985

[51] Int. Cl.[4] ..... F02M 1/16

[52] U.S. Cl. ..... 123/187.5 R; 123/180 P; 239/590

[58] Field of Search ..... 123/187.5 R, 180 P, 123/180 R; 239/590.3, 600, 590, DIG. 19

[56] References Cited

U.S. PATENT DOCUMENTS

| | | | |
|---|---|---|---|
| 1,450,929 | 4/1923 | Sweet | 123/180 P |
| 2,601,562 | 6/1952 | Schoeppner et al. | 123/187.5 R |
| 3,494,343 | 2/1970 | Nutten | 123/187.5 R |
| 3,978,839 | 9/1976 | DuBois et al. | 123/187.5 R |
| 3,985,113 | 10/1976 | DuBois et al. | 123/187.5 R |
| 4,197,825 | 4/1980 | Altenbach | 123/187.5 R |
| 4,203,405 | 5/1980 | Schultz et al. | 123/187.5 R |
| 4,204,511 | 5/1980 | Morris | 123/187.5 R |
| 4,286,553 | 9/1981 | Baltz et al. | 123/187.5 R |
| 4,309,968 | 1/1982 | DuBois | 123/187.5 R |
| 4,326,485 | 4/1982 | Burke | 123/187.5 R |
| 4,373,479 | 2/1983 | Billingsley et al. | 123/187.5 R |
| 4,375,206 | 3/1983 | Baltz et al. | 123/187.5 R |
| 4,457,271 | 7/1984 | Fitch | 123/187.5 R |
| 4,462,346 | 7/1984 | Haman et al. | 123/73 A |
| 4,466,412 | 8/1984 | McChesney et al. | 123/492 |

FOREIGN PATENT DOCUMENTS

| | | | |
|---|---|---|---|
| 688161 | 2/1953 | United Kingdom | 239/590.3 |

*Primary Examiner*—Andrew M. Dolinar

*Attorney, Agent, or Firm*—Andrus, Sceales, Starke & Sawall

[57] ABSTRACT

A wet priming mechanism for small internal combustion engines. A priming line connects the main fuel line leading to the engine and the intake port to the cylinder. A manual bulb-type priming pump is located in the priming line and through operation of the pump, fuel is drawn from the main line and is discharged directly to the cylinder. Located at the discharge end of the priming line is a restrictor assembly which defines a small unobstructed orifice. The orifice is sized so that air will be freely discharged from the priming line by operation of the pump without resistance, but provides a substantial resistance to the flow of fuel. Through operation of the priming bulb, a measured amount of fuel can be injected into the engine to aid in starting.

2 Claims, 5 Drawing Figures

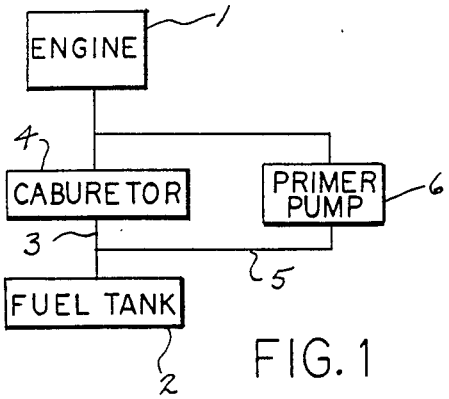
FIG. 1
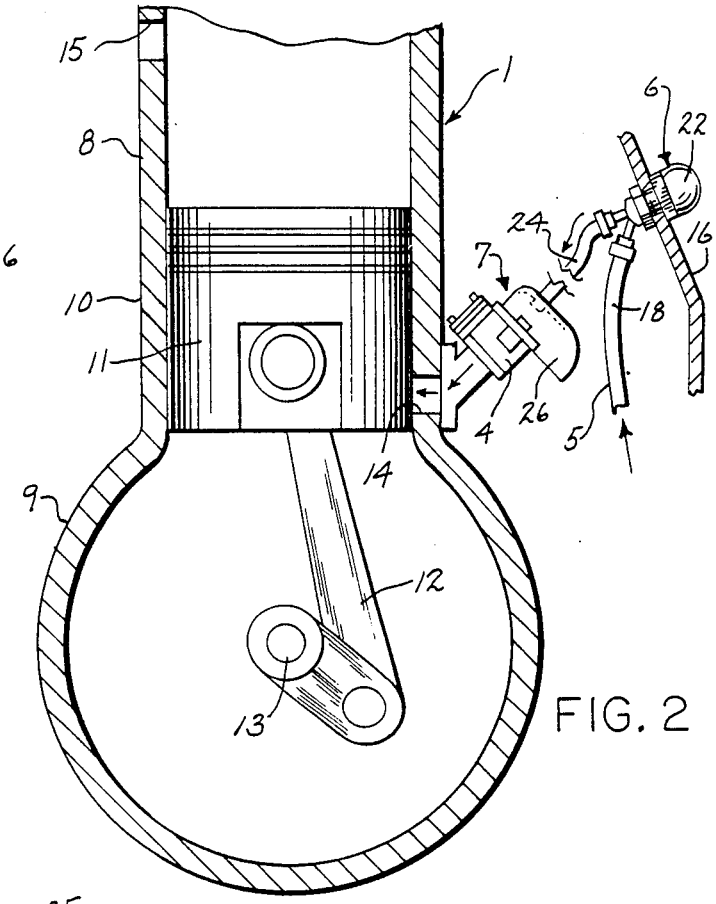
FIG. 2
FIG. 4
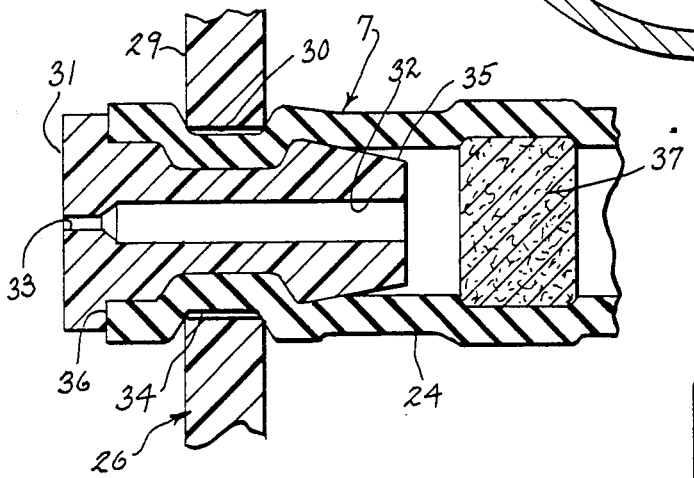
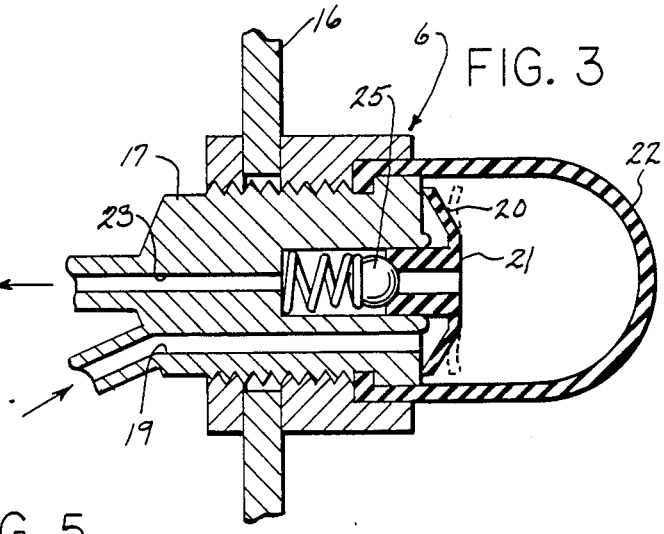
FIG. 3
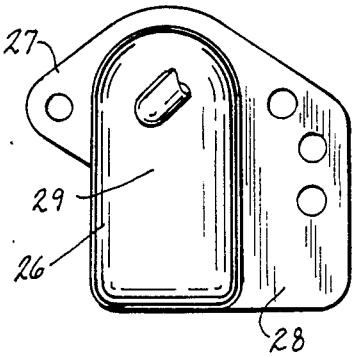
FIG. 5

WET PRIMING MECHANISM FOR AN INTERNAL COMBUSTION ENGINE

BACKGROUND OF THE INVENTION

Small internal combustion engines, such as those used in snowblowers, lawnmowers, generators, and the like are generally manually cranked through operation of a pull rope. In cold weather, oil thickens, slowing the cranking speed, and gasoline will not vaporize as readily. This results in the engine being more difficult to start in cold weather. Choking aids in cold weather starting but extensive choking can cause flooding and stalling of the engine.

To aid cold weather starting, priming systems have been utilized with internal combustion engines. In dry priming systems, pressurized air is injected through a manually operated primer pump into the fuel chamber, while in wet priming systems, fuel is injected directly into the cylinder. However, wet priming systems, as used in the past, have been relatively complex and expensive and in some cases have been tied in directly with the fuel pump.

SUMMARY OF THE INVENTION

The invention is directed to an improved wet priming system for small internal combustion engines. In accordance with the invention, a priming line connects the main fuel line leading to the engine and the intake port to the cylinder or crankcase. A manual bulb-type priming pump is located in the priming line and through operation of the pump, fuel is drawn from the main line and discharged directly to the cylinder.

Located at the discharge end of the priming line, is a restrictor that defines a small, unobstructed orifice. The diameter of the orifice is sized so that air can be discharged freely from the priming line by operation of the pump without resistance, but provides substantial resistance to the flow of fuel.

To operate the priming system, the operator depresses the bulb-type pump. causing fuel to be drawn from the main fuel line and the resultant discharge of air through the primer line to the engine. After several squeezes of the bulb, the firmer feel of the bulb communicates to the operator that he has evacuated the air in the priming system and can then prime the engine. A number of deliberate priming strokes are then employed to discharge a controlled amount of fuel into the engine.

The priming device of the invention is of simple construction which provides instantaneous fuel delivery to the engine, thereby reducing the number of cranking pulls required to start the engine. The priming system has particular use in cold weather, or with a "dry" fuel system, i.e. no fuel in the line.

The priming procedure can be readily learned and applied by the operator and guess-work is eliminated.

The quantity of the priming fuel charge is controlled for predictable starting. However, even if excessive priming occurs the engine will start.

The priming mechanism can deliver starting fuel directly to the cylinder intake port, bypassing the carburetor and fuel pump. Since it is possible to run the engine by actuating the primer, a malfunctioning fuel pump or carburetor can be diagnosed, if the engine does not run without priming.

Other objects and advantages will appear in the course of the following description.

DESCRIPTION OF THE DRAWINGS

The drawings illustrate the best mode presently contemplated of carrying out the invention.

In the drawings:

FIG. 1 is a schematic view of the priming mechanism of the invention;

FIG. 2 is a fragmentary sectional view of an internal combustion engine incorporating the priming mechanism;

FIG. 3 is a sectional view of the bulb-type priming pump;

FIG. 4 is a sectional view of the restrictor assembly; and

FIG. 5 is a plan view of the housing for the restrictor assembly.

DESCRIPTION OF THE PREFERRED EMBODIMENT

FIG. 1 is a schematic view of the priming mechanism of the invention as incorporated with an internal combustion engine 1. A tank 2 containing fuel is connected through a main fuel line 3 to the carburetor 4 for the engine. One end of a priming line 5 is connected to main fuel line 3 upstream of the carburetor, while the opposite end of the priming line 5 is connected to the intake port of the engine.

A manually operated primer pump 6 is located in priming line 5 and acts to draw fuel from the main fuel line 3 and discharge the fuel through a restrictor assembly 7 into the intake port of the engine.

Engine 1 is shown in FIG. 2 as a two-cycle engine, but it is contemplated that the priming system of the invention can also be incorporated with a four-cycle engine. Engine 1 includes an engine block 8 defining a crank case 9 and a cylinder 10 extends outwardly from crankcase 9 and piston 11 is mounted for reciprocating movement in cylinder 10. Piston 11 is carried by piston rod 12, which is connected to the crank shaft 13 of the engine.

Fuel is introduced into the engine through an intake port 14 and the exhaust gases are withdrawn through an exhaust port 15.

Engine block 8 also includes a conventional transfer passage, not shown, which, during reciprocation of the piston, provides communication between crankcase 9 and cylinder 10.

As illustrated in FIG. 2, the primer pump 6 is mounted to a fixed frame or support 16 that is connected to engine 1. As best shown in FIG. 3, pump 6 includes a body 17 and the suction section 18 of priming line 5 is connected to an inlet passage 19 in body 17. The inner end of passage 19 is normally closed by the periphery 20 of a resilient, flexible, umbrella valve 21.

Secured to the outer surface of body 17 is a flexible bulb 22, and a central passage 23 formed in body 17 communicates with the interior of bulb 22. The outer end of passage 23 is connected to the discharge section 24 of priming line 5. A spring loaded check valve 25 is mounted in passage 23 and permits the flow of fluid in a direction through the discharge section 24, but prevents flow in the opposite direction. Compressing of bulb 22 will discharge air from bulb 22 through line 24 to the engine, and subsequent release of the bulb will draw fuel through the suction line section 18 into the interior of the bulb. Further squeezing of the bulb 22 will discharge the fuel from the bulb through the check valve 25 and discharge line 24 to the engine.

Restrictor assembly 7, which is connected to the end of discharge line 24, includes a housing 26 having a pair of flanges 27 and 28 which are connected, as illustrated in FIG. 2, to the carburetor 4. Housing 26 is provided with a dome-like wall 29 having an opening 30.

As illustrated in FIG. 4, an adaptor 31 is located in the downstream end of line 24 and is mounted within the opening 30 in wall 29. Adaptor 31 includes an axial passage 32 which terminates in a small diameter orifice 33. In practice the orifice has a diameter of about 0.015 inch.

As illustrated in FIG. 4, adaptor 31 has a central waist portion 34 of reduced diameter and a tapered end 35. The opposite end of adapter 31 is formed with an annular shoulder 36 and the end of the discharge line 24 bears against shoulder 36.

A filter 37 such as a bronze sintered metal filter, can be located upstream of adaptor 31 and serves to remove foreign material from the fuel that may cause clogging of orifice 33.

To install the adaptor 31, the end of the discharge line or tube 24, is initially inserted over the adaptor and the adaptor, with the tube 24 contained therearound, is then pushed in an upstream direction into the opening 30. The inner tapered end 35 of the adaptor aids in positioning the adaptor within the opening, and the resilient nature of the tubing 24 enables the adaptor to snap into place, with waist portion 34 engaged with opening 30 in wall 29, as illustrated in FIG. 4.

To operate the priming mechanism, bulb 22 is squeezed, which will discharge air through the discharge tube 24 to the engine. The orifice 33 is sized, so that air will pass freely through the orifice without restriction.

On release of the bulb 22, fuel will be drawn from the main fuel line through the inlet tube 18 into the bulb. Subsequent squeezing and release of the bulb will discharge all of the air from the primary system.

Orifice 33 is sized such that it will cause a restriction to the discharge of liquid fuel. Thus, when the discharge tube 24 is filled with fuel, the firmer feel of the bulb will communicate to the operator that the air has been evacuated and the system is ready to supply fuel to the engine. By the number of slow and deliberate priming squeezes, a controlled amount of fuel can be injected directly into the engine to aid in starting of the engine.

The wet priming system of the invention aids in starting of the engine in cold weather and also with a "dry" fuel system where the main fuel line does not contain fuel.

The priming procedure is simple and can be readily used by the operator without guesswork. By employing a designated number of priming strokes, the amount of fuel supplied to the engine can be controlled for predictable starting.

While the drawings have illustrated the priming system of the invention as incorporated with a two-cycle engine, it is also contemplated that the syatem can be used with four-cycle engines in which the fuel is injected into the intake valve port area.

Similarly, FIG. 2 shows the restrictor assembly 7 mounted on the carburetor, so that fuel is injected directly through the choke plate, which in the closed position encloses only half of the carburetor throat. In other installations the restrictor assembly can be mounted directly on the engine block or intake manifold to introduce fuel through the intake port or other opening into the engine.

The fuel supply system shown in the drawings is a gravity feed system in which the fuel is fed by gravity to the engine, so that a fuel pump is not required. If the priming system is used with a fuel system employing a fuel pump, the upstream end of the priming line 5 is connected between the fuel tank and the fuel pump.

Various modes of carrying out the invention are contemplated as being within the scope of the following claims particularly pointing out and distinctly claiming the subject matter which is regarded as the invention.

I claim:

1. A wet priming mechanism for an internal combustion engine, comprising an engine block defining a combustion chamber and having an opening therein communicating with said chamber, a fuel tank to contain a liquid fuel, a main fuel line connecting the fuel tank with the combustion chamber for supplying fuel to the chamber, a priming conduit providing a connection between said fuel tank and said chamber and having an inlet end communicating with said fuel tank and a discharge end communicating with said chamber, manual pumping means disposed in said priming conduit for pumping fuel in a direction toward said discharge end, said restrictor means comprising a housing having an opening, an adaptor containing said orifice, said priming conduit including a flexible resilient tube disposed around said adaptor, said adaptor having a central waist portion of reduced cross sectional area, said waist portion being in registry with said opening, the diameter of said opening being less than the combined external diameter of said tube and the portion of the adaptor located on either side of said waist portion, said tube being sufficiently resilient to enable said waist portion to be press fitted into registry with said opening.

2. The mechanism of claim 1, and wherein said adaptor has a tapered end disposed upstream of said waist portion and the opposite end of said adaptor has an enlarged shoulder, an end of said priming conduit bearing against said shoulder.

* * * * *